US006224538B1

(12) United States Patent
Wang et al.

(10) Patent No.: US 6,224,538 B1
(45) Date of Patent: May 1, 2001

(54) MULTI-FUNCTION HEALTH DEVICE

(76) Inventors: Jun Ming Wang, No. 7, Chia Tung Rd., His Chin, Taipei Hsien; Chin Yi Hung, 3F, No. 3, Lane 263, Sec. 3, Min Sheng Rd., Pan Chiao, Taipei Hsien, both of (TW)

( * ) Notice: Subject to any disclaimer, the term of this patent is extended or adjusted under 35 U.S.C. 154(b) by 0 days.

(21) Appl. No.: 09/356,370

(22) Filed: Jul. 19, 1999

(51) Int. Cl.[7] ..... A61G 10/00
(52) U.S. Cl. ..... 600/19
(58) Field of Search ..... 600/19–21; 128/202.12, 128/205.26, 202.11; 602/13; 601/22, 28

(56) References Cited

U.S. PATENT DOCUMENTS 3,661,145 * 5/1972 Breger ..... 600/21
3,751,727 * 8/1973 Shepard et al. ..... 600/20 X
3,785,375 * 1/1974 Lipson ..... 602/13
5,127,896 * 7/1992 De Gaston ..... 600/20
5,245,993 * 9/1993 McGrady et al. ..... 128/202.11 X
5,288,286 * 2/1994 Davis et al. ..... 602/13 X
5,421,340 * 6/1995 Stanga et al. ..... 600/21 X
5,716,331 * 2/1998 Chang ..... 601/28 X
5,724,996 * 3/1998 Piunti ..... 128/898
5,725,472 * 3/1998 Weathers ..... 600/21
5,797,859 * 8/1998 Prehodka ..... 601/22 X
5,891,186 * 4/1999 Daffer et al. ..... 600/21 X

* cited by examiner

*Primary Examiner*—Samuel G. Gilbert
*Assistant Examiner*—Joseph A. Cadugan
(74) *Attorney, Agent, or Firm*—Rosenberg, Klein & Lee

(57) ABSTRACT

A multi-function health device is provided that includes a gas inflatable short clothes, a gas inflatable short trousers, and at least one pair of gas inflatable tubes connected to gas transmission tubes. The user may selectably wear gas inflation tubes on the user's arms or legs, or the gas inflation tubes are used in combination with the gas inflatable short clothes or gas inflatable short trousers.

3 Claims, 5 Drawing Sheets

MULTI-FUNCTION HEALTH DEVICE

BACKGROUND OF THE INVENTION

1. Field of the Invention

The present invention relates to a multiple functional health device, and especially to a novel design wherein by repeatedly apply release pressure to the human body, the activities of muscle and blood vessel are improved so that the health of the human body is also improved. Meanwhile, the present invention can serve to measure the blood pressure and pulse. Further, human acupuncture points can be massaged by the present invention.

2. Description of the Prior Art

With the progress of society and life, modern people takes much attention to his (or her) or friend's health. Thus, devices for health are widely installed indoors, which may attain similar functions as some outdoor devices and has the functions of massage and dredging blood. One of such kind of prior art device includes an air transmission machine, a gas transmission tube, a gas inflation clothes with long sleeves, a gas inflation long trousers. As a user wears the gas inflation clothes of gas inflation trousers, the gas inflation clothes and the gas inflation trousers are connected to the air transmission machine through gas transmission tubes. The air transmission machine is installed with pressure regulator which output air to the gas inflation clothes and the gas inflation trousers so as to inflate continuously and then a pressure is applied to the human body. When the pressure attain a predetermined value, the system will release air. When the pressure is reduced to a predetermined value or for a predetermined time period, air is inflated again. Thus pressure is increased and decreased repeatedly. Therefore, the blood vessel of human body is stimulated and the health effect of the blood transmission with oxygen will be attained. Thus, the organizations under skins will be stimulated, and grease is consumed, so that the user will become thinner. Moreover, the blood vessels will become more elastic.

However, in the prior art health machine, in order that the arms, legs and other components of body may suffer pressure, thus gas inflation clothes with long sleeves and gas inflation long trousers are prepared. A used can not select the part for stimulation, for example, only arms or legs, or some part of body, such as waist. When a user wears gas inflation trousers, the bottom, calves, and thighs must suffer from stimulation at the same time. Thus activity of the prior art device is bad and some trouble is induced. Moreover, over-stimulation will occur so that the user will feel uncomfortable. Although Taiwan Patent Publication No. "Pneumatic foot massaging device". However, such prior art machine only locally stimulates foot or arms or waists. Thus it can not be used to the whole body.

In other aspect the conventional pneumatic blood circulation health device increases and decreases pressure repeatedly so as to stimulate the circulation of blood or compress grease. While other feature in pressure variation can not be effectively used. For example, thus the gas inflation trouser, gas inflation clothes and gas inflation tubes encloses the body tightly. Thus, the blood pressure and pulse are easily sensed by using this feature. Other functions for releasing ache of muscle and fatigue can not be developed by using the tight adhesion of the gas inflation trousers, gas inflation clothes and gas inflation tubes.

SUMMARY OF THE INVENTION

Accordingly, the object of the present invention is to provide a multiple functional health device comprising a gas inflation short clothes, a gas inflation short trousers, and at least one gas inflation tubes connecting by gas transmission tubes. The user may selectably wear gas inflation tubes on the arms or legs, or the gas inflation tubes are used incorporating with the gas inflation short clothes or gas inflation short trousers. Thus, the user may exercise locally or wholly so as to attain the object of dredging blood.

Another object of the present invention is to provide a multiple functional health device. Wherein a sphygmomanometer is extra installed to the air transmission machine for measuring the blood pressure due to the present increment or decrement of the air transmission machine. Thus, the blood pressure is displayed as a user wears the gas inflation short clothes, gas inflation short trousers or the gas inflation tubes. Further, since the gas inflation short clothes, gas inflation short trousers and the gas inflation tubes are tightly adhered to the human body so that the pulses can be sensed. Therefore, a pulse meter may also be installed in the air transmission machine. Therefore, a user may know the body condition himself (or herself).

A further object of the present invention is to provide a multiple functional health device. Wherein by the property that gas inflation short clothes, gas inflation short trousers and the gas inflation tubes are tightly adhered to the body, a heater can be installed with the air transmission machine for supplying heat toe the gas inflation short clothes, gas inflation short trousers and the gas inflation tubes so as to thermally massaging the body. Therefore, during exercising, the user may attain the effects of releasing the ache of muscles and fatigue.

A yet object of the present invention is to provide a multiple functional health device. Massage devices, for example, massaging pads with a plurality of convex particles, or electric treating pieces, can be selectably installed on the gas inflation short clothes, gas inflation short trousers or the gas inflation tubes. Therefore, during exercising, the user may attain the effects of releasing the ache of muscles and fatigue.

The present invention will be better understood and its numerous objects and advantages will become apparent to those skilled in the art by referencing to the following drawings in which:

DETAILED DESCRIPTION OF THE PREFERRED EMBODIMENT

Figure 1:
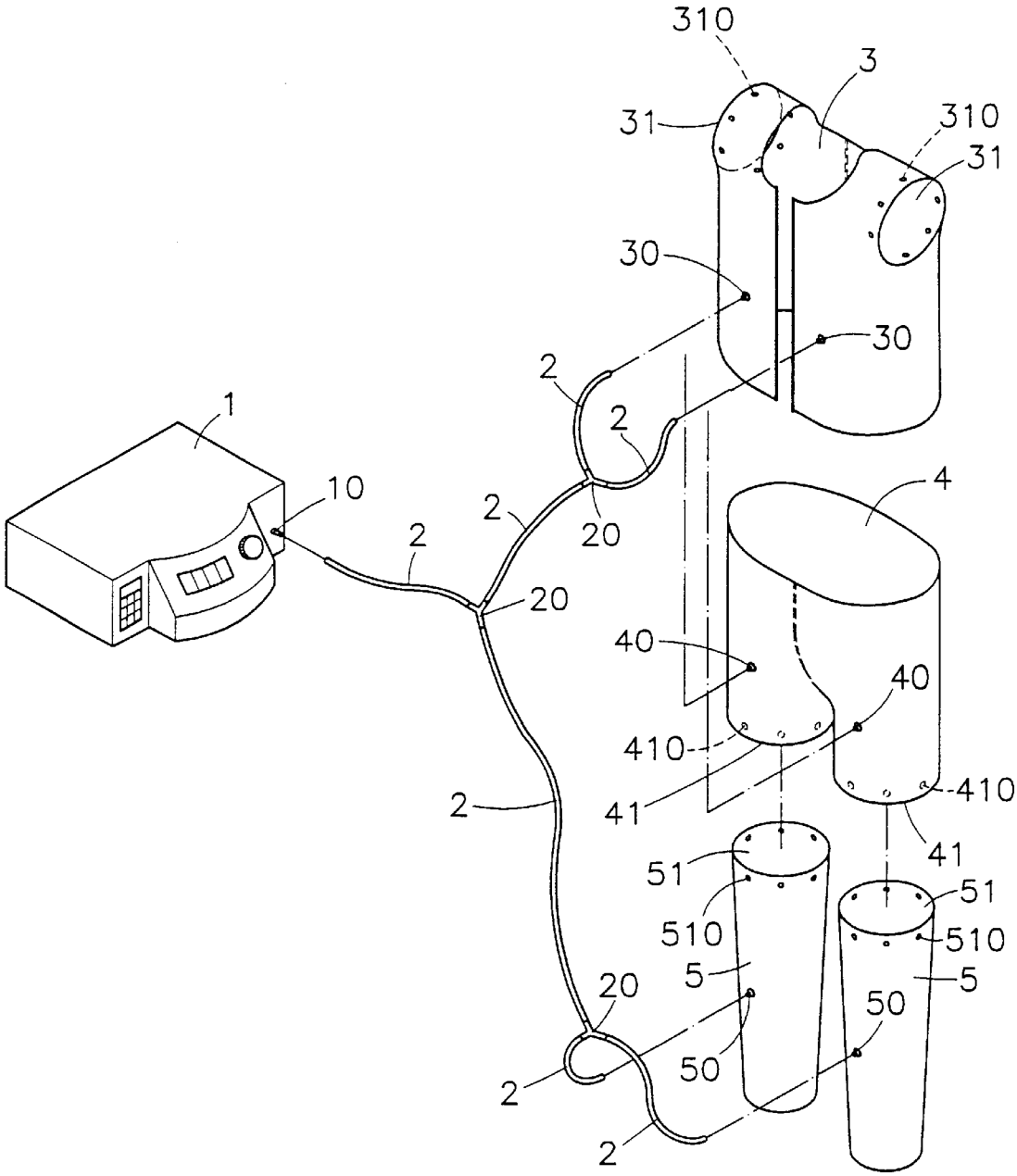
FIG. 1 is an exploded perspective view of the present invention.
Figure 2:
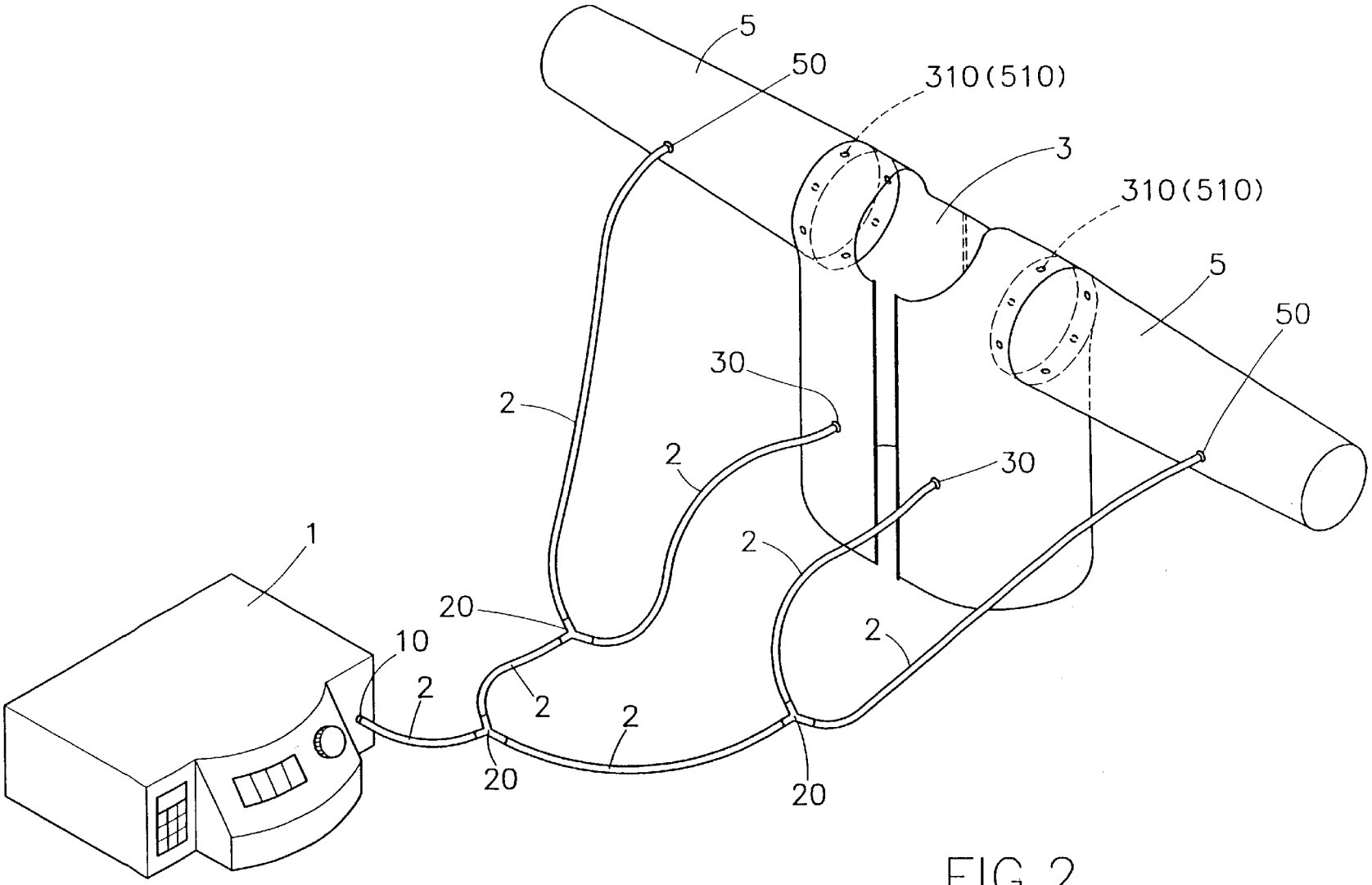
FIG. 2 is a schematic perspective view showing one application of the present invention.

As shown in FIG. 1, the exploded perspective view of the multiple functional health device in the embodiment of the present invention is illustrated. The multiple functional health device according to the present invention includes an air transmission machine 1, a gas transmission tube set including at least one gas transmission tube 2, sleeveless or short sleeve gas inflation short clothes 3, gas inflation short trousers 4 and at least one pair of gas inflation tubes 5.

Figure 5:
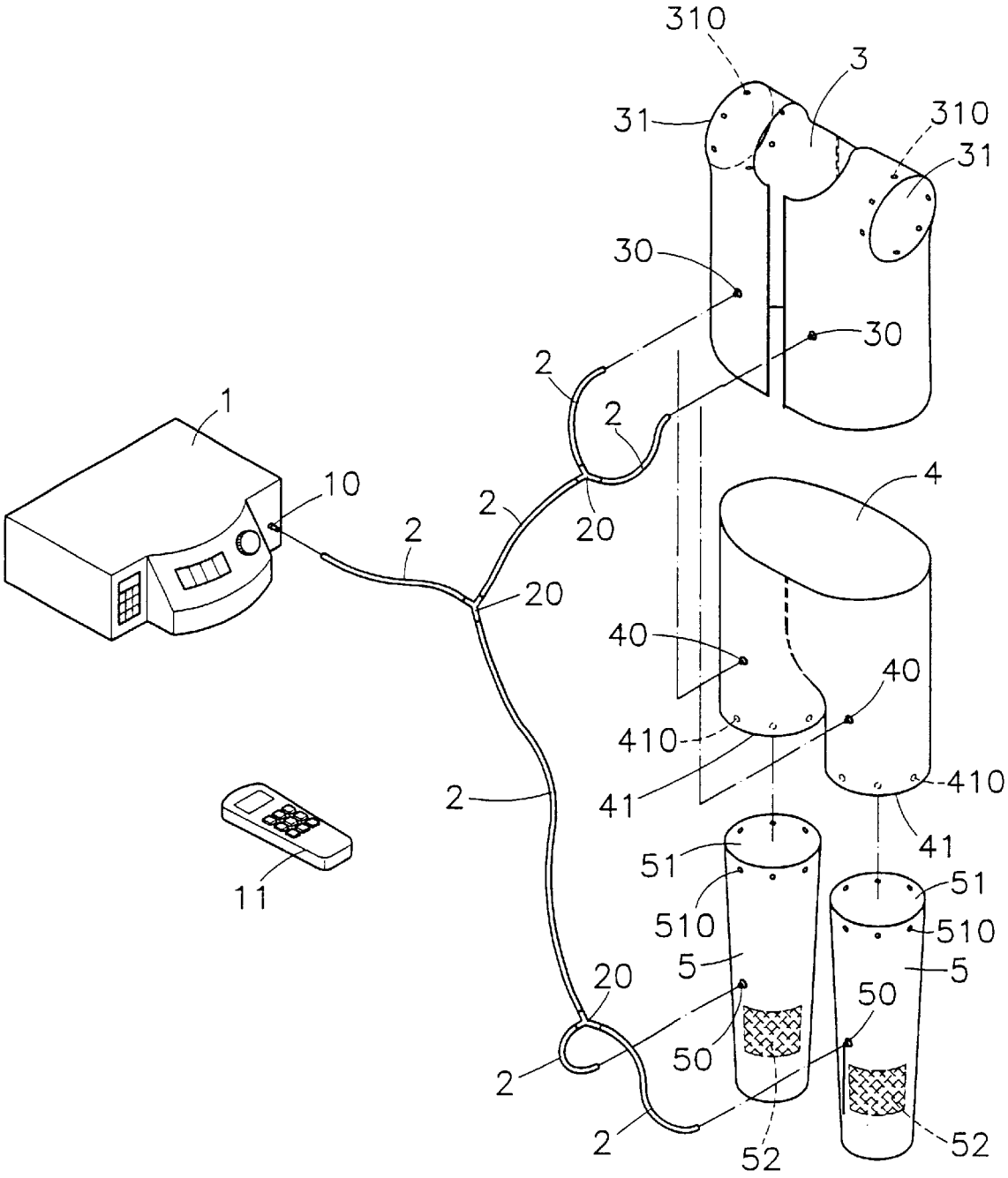
FIG. 5 is a exploded perspective view showing another embodiment of the present invention.

A air transmission machine 1 is installed with a air pump and a pressure regulating controller which can cause the pump release gas as the gas pressure has increased to a predetermined value and cause the pump to pump gas as the gas pressure is reduced to a predetermined value. A receptacle 10 for being inserted by the gas transmission tube 2 is located aside an operating plate and the air transmission machine 1 can be remotely controlled by a remote controller 11 (as another embodiment shown in FIG. 5). p Receptacles 30, 40 and 50 are installed at the gas inflation short trousers 3, gas inflation short clothes 4, and the gas inflation tubes 5 for being inserted by the gas transmission tube. Connectors 310, 410, and 510 are installed on the cuffs 31 of the gas inflation short clothes 3, the opening 41 of the gas inflation short trousers 4 and opening 51 of the gas inflation tubes 5, which serves to be installed with buttons, male and female pressing buttons, or sticky buttons, or other joints so that the gas inflation short clothes 3 may be connected to the gas inflation tubes 5 or the gas inflation short trousers 4 are connected to the gas inflation tubes 5. Therefore, sleeveless or short sleeves gas inflation short clothes 3 are changed as a long sleeve gas inflation long clothes, and gas inflation short trousers are changed as gas inflation long trousers.

The gas transmission tubes set is formed by the gas transmission tubes to be connect by a multiple branch tube 20 (such as the three-way tube shown in the figure) connected with one another so as to form as a plurality of tree type branches. The gas transmission tube set may be selectable to connect the gas inflation short clothes 3, the gas inflation short trousers 4 or the gas inflation tubes 5 to the air transmission machine 1 at the same time so as to change air pressure.

Figure 3:
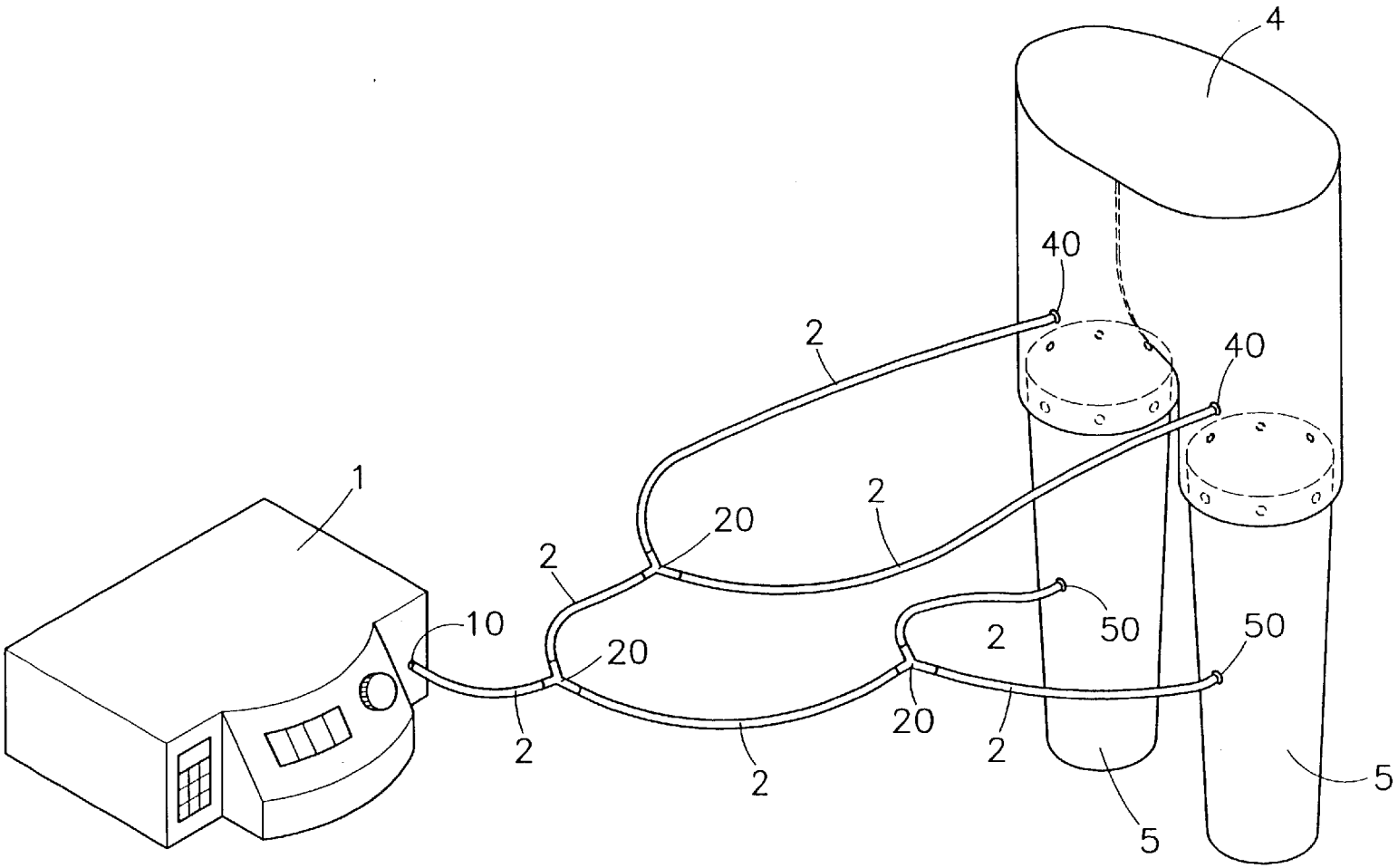
FIG. 3 is a schematic perspective view showing another application of the present invention.
Figure 4:
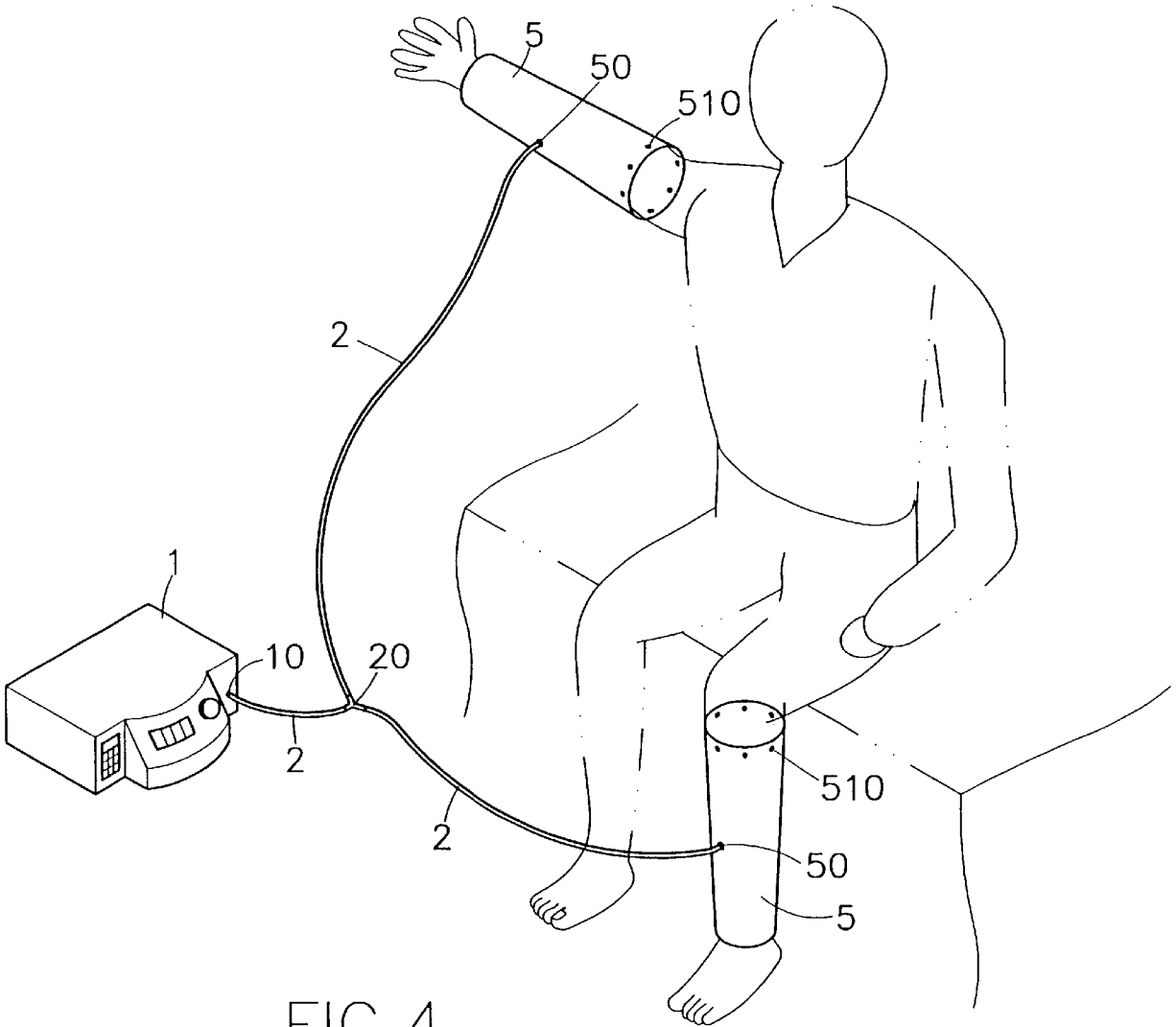
FIG. 4 is a schematic perspective view showing a further application of the present invention.

Accordingly, by structure formed by the independent gas inflation short clothes 3, gas inflation short trousers 4 and the gas inflation tubes 5, a user may selectably wear the gas inflation short clothes 3, gas inflation short trousers 4 and the gas inflation tubes 5 according to the part required for exercising so as to dredge blood. For example, if a user desires to dredge the blood of upper body, he (or she) can only wear the gas inflation short clothes 3. If a user desires to dredge blood of bottom and thighs, he only needs to wear the gas inflation short trousers 4. If a user desires the dredge blood of the upper body, bottom and thigh, then he may wear the gas inflation short clothes 3 and the gas inflation short trousers 4. If he wants to dredge blood of upper body and arms, as shown in FIG. 3, he may wear the gas inflation short clothes 3 and wear the gas inflation tubes 5 on the calves 31. If he want to dredge blood of the bottom, thighs, and calves, then he may wear the gas inflation short trousers 4 and the gas inflation tubes 5, as shown in FIG. 3. IF he wants to dredge blood of the arms and/or calves, as shown in FIG. 4, he may only wear the gas inflation tube 5 on the arms and/or calves.

Therefore, users may selectably wear at least one of the gas inflation short clothes 3, gas inflation short trousers 4 and the gas inflation tubes 5, as desired according to the parts dredged blood including body, arms, bottom, thighs, calves. Moreover, the multiple functional health device can be used by several peoples.

Alternatively, since the pressures of the gas inflation short clothes 3, gas inflation short trousers 4 and the gas inflation tubes 5 can be increased or decreased by the air transmission machine 1. Thus, a sphygmomanometer is extra installed to the air transmission machine 1 for measuring the blood pressure due to the pressure increment or decrement of the air transmission machine and thus, the blood pressure is displayed as a user wearing the gas inflation short clothes 3, gas inflation short trousers 4 or the gas inflation tubes 5. Further, since the gas inflation short clothes 3, gas inflation short trousers 4 and the gas inflation tubes 5 are tightly adhered to the human body so that the pulses can be sensed. Therefore, a pulse meter may also be installed in the air transmission machine 1. Therefore, as a user wearing the gas inflation short clothes 3, gas inflation short trousers 4 or the gas inflation tubes 5 for exercising, the pulses of the user can be displayed.

Moreover, when the gas inflation short clothes 3, gas inflation short trousers 4 and gas inflation tubes 5 vents or pumps gas, they not only apply pressures to the body, but also the pressure is changed continuously. Therefore, this pressure will stimulate the human acupuncture points, thus massage devices 52, for example, massaging pads with a plurality of convex particles, or electric treating pieces, can be selectably installed on the gas inflation short clothes 3, gas inflation short trousers 4 or the gas inflation tubes 5. By the property that gas inflation short clothes 3, gas inflation short trousers 4 and the gas inflation tubes 5 are tightly adhered to the body, a heater can be installed in the air transmission machine 1 for supplying heat to the gas inflation short clothes 3, gas inflation short trousers 4 and the gas inflation tubes 5 so as to thermally massaging user's body. Therefore, during exercising, the user may attain the effects of releasing the ache of muscles and fatigue.

In summary, the multiple functional health device of the present invention has improved many drawbacks in the prior art air pressure blood cycle health device and can be used widely and selectable according to requirement of users. Although the present invention has been described using specified embodiment, the examples are meant to be illustrative and not restrictive. It is clear that many other variations would be possible without departing from the basic approach, demonstrated in the present invention.

What is claimed is:

1. A multi-function health device comprising:

an air transmission machine installed with a pump and an air pressure regulating controller for automatically reducing air pressure when air pressure has increased to a predetermined value and then causing the air pump to pump air for increasing air pressure after the air pressure has been reducing for a predetermined time period, the air pressure thereby being increased and decreased repeatedly;

a gas transmission tube set formed by a plurality of gas transmission tubes which are connected by at least one multiple branch tube, and one end of the gas transmission tube set being connected to the air transmission machine; and, a plurality of inflatable clothing pieces selectively worn by a user and coupled to said gas transmission set, the plurality of inflatable clothing pieces including:

a. gas inflatable short clothes worn on a user's upper body and connected to the gas transmission tubes for cyclic inflation and deflation, the gas inflatable short clothes having openings for a user's arms to pass therethrough;

b. gas inflatable short trousers worn on a user's lower body and connected to the gas transmission tubes for cyclic inflation and deflation, the gas inflatable short trousers having openings for a user's legs to pass therethrough; and, c. at least one pair of gas inflatable tubes connected to the gas transmission tubes and selectively worn on (i) a user's arms or legs independent of the gas inflatable short clothes and the inflatable short trousers or (ii) coupled to at least one of the gas inflatable short clothes and the gas inflatable short trousers.

2. The multi-function health device as claimed in claim 1, wherein connectors are installed circumscribing the openings of the gas inflatable short clothes, the openings of the gas inflatable short trousers and openings of the gas inflatable tubes for selectively connecting the gas inflatable tubes to the gas inflatable short trousers and the gas inflatable short clothes.

3. The multi-function health device as claimed in claim 2, wherein the connectors are female and male pressing buttons.

* * * * *